US010513941B2

(12) United States Patent
Smith et al.

(10) Patent No.: US 10,513,941 B2
(45) Date of Patent: Dec. 24, 2019

(54) LEVERED JOINT

(71) Applicant: ROLLS-ROYCE PLC, London (GB)

(72) Inventors: William James Smith, Bristol (GB); Andrew Shorney, Derby (GB); Paul Mawhinney, Bristol (GB)

(73) Assignee: ROLLS-ROYCE plc, London (GB)

( * ) Notice: Subject to any disclaimer, the term of this patent is extended or adjusted under 35 U.S.C. 154(b) by 655 days.

(21) Appl. No.: 15/225,069

(22) Filed: Aug. 1, 2016

(65) Prior Publication Data

US 2017/0051622 A1 Feb. 23, 2017

(30) Foreign Application Priority Data

Aug. 18, 2015 (GB) ..... 1514650.9

(51) Int. Cl.

*F01D 11/00* (2006.01)
*F01D 11/02* (2006.01)
*F01D 21/04* (2006.01)

(52) U.S. Cl.

CPC ..... *F01D 11/02* (2013.01); *F01D 11/001* (2013.01); *F01D 21/045* (2013.01); *F05D 2220/32* (2013.01); *F05D 2240/12* (2013.01); *F05D 2240/24* (2013.01); *F05D 2270/09* (2013.01)

(58) Field of Classification Search

CPC ..... F01D 11/001; F01D 11/02; F01D 21/045
See application file for complete search history.

(56) References Cited

U.S. PATENT DOCUMENTS

| | | | | |
|---|---|---|---|---|
| 4,498,291 | A | 2/1985 | Jeffery | |
| 4,505,104 | A | 3/1985 | Simmons | |
| 7,201,529 | B2 * | 4/2007 | Lejeune | F01D 21/045 403/2 |
| 7,264,442 | B2 * | 9/2007 | Harding | F01D 11/001 415/173.7 |
| 2003/0233822 | A1 | 12/2003 | Albrecht et al. | |

FOREIGN PATENT DOCUMENTS

EP 1357295 A2 10/2003

OTHER PUBLICATIONS

Feb. 18, 2016 Search Report issued in British Patent Application No. 1514650.9.
Dec. 21, 2016 Search Report issued in European Patent Application No. 16182194.

* cited by examiner

*Primary Examiner* — Woody A Lee, Jr.
*Assistant Examiner* — Christopher R Legendre
(74) *Attorney, Agent, or Firm* — Oliff PLC

(57) ABSTRACT

A gas turbine engine, configured with a first chamber and a second chamber separated by a partition wall; wherein the partition wall includes a stationary element and a rotating element separated by a seal and either of the stationary element and the rotating element of the partition wall is segmented by a levered joint. The levered joint includes a lever having a trigger plate, a fixture portion and a fulcrum portion; and, the other of the stationary element and rotating element includes a hammer which is axially aligned and separated from the trigger plate in a first position, and forcibly contacts the hammer portion in a second position so as to create a moment on the lever via the trigger plate, the moment forcing the levered joint apart.

14 Claims, 5 Drawing Sheets

LEVERED JOINT

TECHNICAL FIELD OF INVENTION

This invention relates to a gas turbine engine having an air chamber which has the potential to act as a pneumatic buffer. In particular, the invention relates to a collapsible wall portion which is designed to fail during certain failure modes.

BACKGROUND OF INVENTION

FIG. 1 shows a ducted fan gas turbine engine 10 comprising, in axial flow series: an air intake 12, a propulsive fan 14 having a plurality of fan blades 16, an intermediate pressure compressor 18, a high-pressure compressor 20, a combustor 22, a high-pressure turbine 24, an intermediate pressure turbine 26, a low-pressure turbine 28 and a core exhaust nozzle 30. A nacelle (not shown) generally surrounds a fan casing 32 and engine 10 and defines the intake 12, a bypass duct 34 and a bypass exhaust nozzle. The engine has a principal axis of rotation 31.

Air entering the intake 12 is accelerated by the fan 14 to produce a bypass flow and a core flow. The bypass flow travels down the bypass duct 34 and exits the bypass exhaust nozzle 36 to provide the majority of the propulsive thrust produced by the engine 10. The core flow enters in axial flow series the intermediate pressure compressor 18, high pressure compressor 20 and the combustor 22, where fuel is added to the compressed air and the mixture burnt. The hot combustion products expand through and drive the high, intermediate and low-pressure turbines 24, 26, 28 before being exhausted through the nozzle 30 to provide additional propulsive thrust. The high, intermediate and low-pressure turbines 24, 26, 28 respectively drive the high and intermediate pressure compressors 20, 18 and the fan 14 by interconnecting shafts 38, 40, 42.

As is well known in the art, the turbines and compressors are each constructed from linear cascades of stator-rotors pairs. The stators and rotors are provided in flow series pairs such that the stator vanes align the upstream air flow to an optimum angle for interaction with the rotor blades. FIG. 2 shows a partial longitudinal section of a turbine interior 210 from an engine similar to that shown in FIG. 1. The turbine section shows a portion of a turbine blade 212 mounted on a rotor disc 214 which is rotatable about the principal axis of the engine 31. The flow direction is left to right as shown in the Figure such that the aero foil portion 216 of the blade receives the air from upstream stator vane (not shown) which is located to the left of the blade 212. The flow of hot air drives the blade 212 and disc 214 into a rotation and provides an axial rearward force. Aft of the rotor is a stator assembly 218. The stator assembly 218 includes the stator vane 219 of the next turbine stage. The stator vane includes an aerofoil portion (not shown) and platform 220 as is known in the art.

A partitioning wall 222 extends from the stator structure radially inwards towards the centre of the engine. The partitioning wall 222 includes a stationary part 224 and a rotating part 226 which are divided by a seal arrangement 228 to allow the required relative rotation. The partitioning wall 222 provides a separation between a first chamber and a second chamber 232. The two chambers are held at respective first and second operational pressures when in use. The first pressure of the first, upstream chamber is higher than the second pressure of the second, downstream chamber 232. The operating pressures are provided by compressor air which is bled from respective stages of the compressor.

The first chamber is constructed from a first wall in the form of the rotor disc 214 and a second wall which is the partition wall 222. The second chamber 232 is constructed from the partition wall 222 and a rotor disc 214 of a second downstream rotor (not shown). The radially outboard end of the first chamber is provided with a gap 234 which separates the rotor from the stator structure to allow for the relative rotation.

The gap 234 includes a seal member in the form of a swan neck rim seal provided by an annular flange which extends axially from the stator assembly towards the rotor. The seal member is located with a suitable clearance which provides a minimal operational separation between the rotor and the stator, thus allowing reasonably sealed and unhindered rotation.

The rotor forms part of a larger rotor structure (not shown). The attachment between the rotor and the larger rotor structure is via a short shaft and flanged connection 238. The flanged connection is fixedly mounted to a corresponding structure with any suitable coupling structure such as an array of bolts.

In operation, hot gas expelled from the combustor expands through the turbine and drives the rotor round and loads it rearwards. The first chamber is provided with reasonably high pressure cooling air bled from the compressor. The pressure of the cooling air is higher than the main gas flow path such that there is a positive pressure head within the engine core and prevents egress of hot gas outside of the protective environment of the main gas path annulus.

The second chamber 232 is provided with cooling air but of a lower pressure relative to the first chamber to reflect the local pressure of the main gas path at that location.

In some failure modes of the engine, for example a shaft break or disconnection of join 238, the rearward loading of the rotor causes it to move backwards and engage with the stator structure 218. In particular, the seal member clashes with the rotor, and trailing edge of the blade platform 240 and leading edge of the stator vane platform 220 collide and mesh together to bring the rotor to a desirable controlled and rapid halt. However, the contact between the seal member and rotor, seals the first chamber creating a pneumatic buffer which dampens the rearward movement of the rotor and binding of the rotating and static structures. This reduces the deceleration of the rotor which is undesirable.

The present invention seeks to provide an improved turbine arrangement which collapses more readily in a failure mode.

STATEMENTS OF INVENTION

The present invention provides a gas turbine engine according to the appended claims.

Described below is a gas turbine engine, comprising: a first chamber and a second chamber separated by a partition wall; wherein the partition wall includes a stationary element and a rotating element separated by a seal and either of the stationary element and the rotating element of the partition wall is segmented by a levered joint, wherein the levered joint includes a lever having a trigger plate, a fixture portion and a fulcrum portion; and, the other of the stationary element and rotating element includes a hammer which is axially aligned and separated from the trigger plate in a first position, the hammer forcibly contacting the trigger plate in a second position so as to create a moment on the lever about the fulcrum portion via the trigger plate, the moment forcing the levered joint apart.

The stationary element may be a stator assembly of the gas turbine engine. The stator assembly may include a stator vane. The rotating element may include a rotor disc. The rotor may include a rotor blade. The stator and rotor may be part of a turbine portion of the gas turbine engine. The first position may relate to a normal operating condition of the engine. The second position may relate to the rearward movement of the rotating element when the engine is in a failure mode. It will be appreciated that the movement from the first to the second position will require a predetermined amount of force to lever the joint apart.

The seal may include the hammer. The seal may be a labyrinth seal having a plurality of fins extending from a seal body and the seal body is the hammer.

The seal may include a seal carrier which radially opposes the seal body. The seal carrier may be radially stepped so as to provide radially separated lands. The lands may oppose individual or groups of fins. An axially upstream land may be radially outboard of a downstream land.

The lever may have a first end at which the trigger plate is located and a second end at which the fulcrum portion is located and the fixture portion is located therebetween. The fulcrum may be located at the terminal end of the lever. The trigger plate may be located at the terminal end of the lever. The fulcrum may be positioned between the trigger plate and fixture portion.

The levered joint may include a first wall abutment and a second wall abutment which are adjacent and abutting one another and the lever is formed from part of the second wall abutment.

The levered joint may include a first wall abutment, a second wall abutment and the lever, wherein the first wall and second wall abutments and lever are axially stacked with the second wall abutment sandwiched between the first wall abutment and level, and the fulcrum portion bears against the first wall abutment The first wall abutment may include a sealing face which sealably engages with the second wall abutment in the first position and provides fluid communication between the first and second chambers in the second position.

A pressure relief vent may be provided in the sealing face of the first wall abutment, the pressure relief vent may be opened when in the second position.

The pressure relief may be an opening in the first wall. The opening may be provided by an aperture or cut out. The cut out may be provided by a castellation in an end edge of the first wall portion.

A plurality of levers may be circumferentially distributed around the partition wall.

The levered joint may include a plurality of circumferentially distributed bolts and wherein each bolt includes a separate lever.

The bolts may be received within a sliding bush. The sliding bush may pass through the lever plate.

The trigger plate may extend from the stationary portion of the seal.

The first chamber may be bounded by a turbine rotor and the rotating part of the partition wall and may be attached to the turbine rotor and the stationary part of the partition wall is attached to a downstream stator assembly.

The turbine rotor may include a turbine blade. The stator assembly may include a stator vane which is downstream and adjacent to one another, the turbine blade and stator vane having platforms which are axially separated by a gap in the first position, wherein the axial separation of the gap is greater than the axial separation of the hammer and trigger plate.

DESCRIPTION OF DRAWINGS

Embodiments of the invention will now be described with the aid of the following drawings of which.

DETAILED DESCRIPTION OF INVENTION

Figure 1:
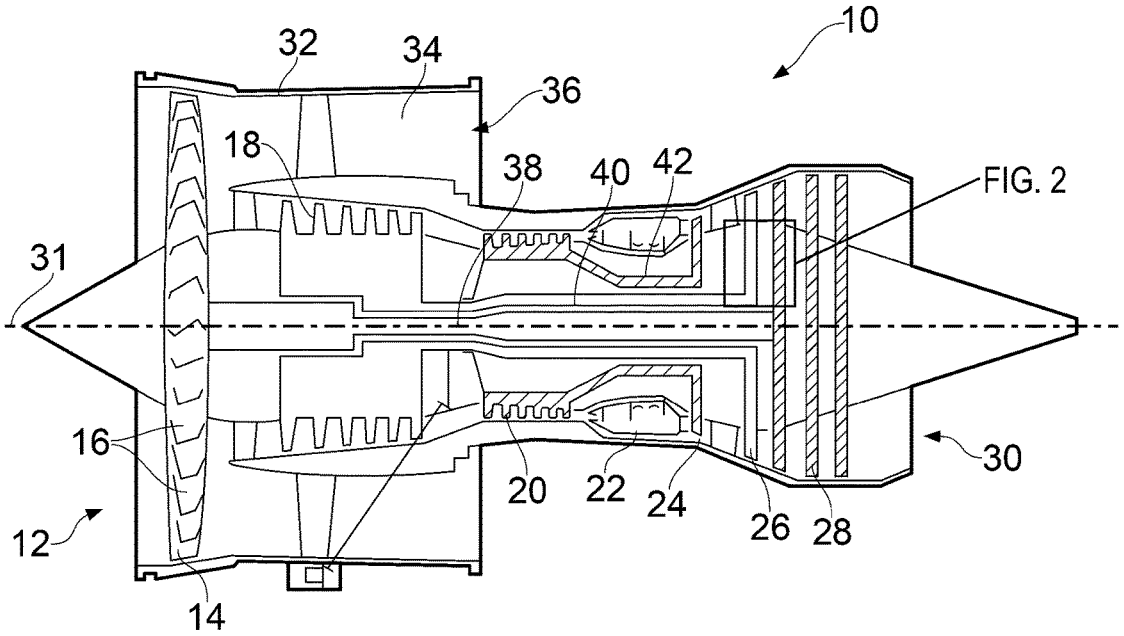
FIG. 1 shows a conventional three shaft gas turbine engine, described above in the Background of Invention section.
Figure 2:
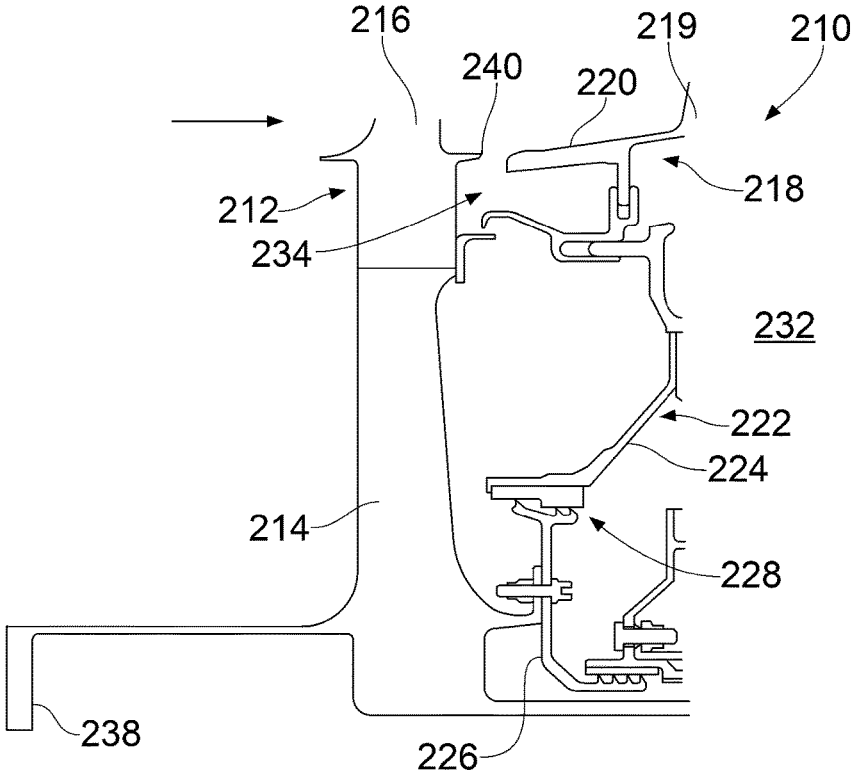
FIG. 2 PRIOR ART
FIG. 2 shows a longitudinal section of a portion of a known turbine.
Figure 3:
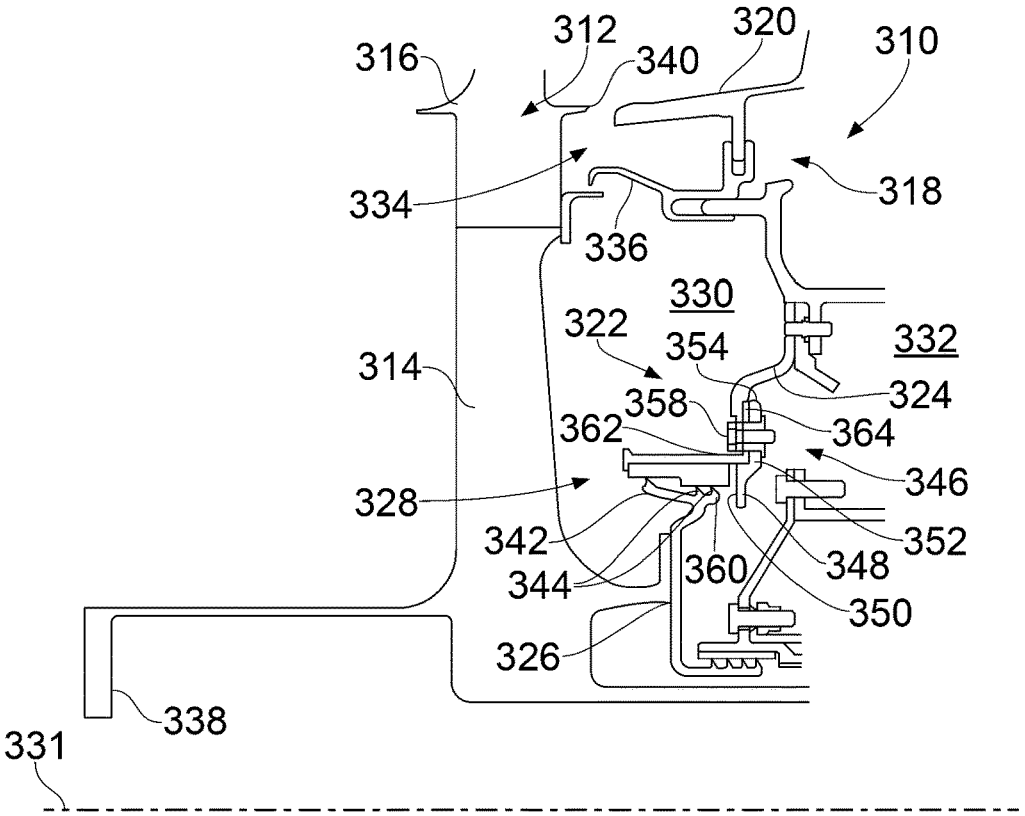
FIG. 3 shows a partial longitudinal section of a partitioning wall in a normally operating configuration.

FIG. 3 shows a partial longitudinal section of the turbine 310 which includes an improved collapsing mechanism for a partition wall. The arrangement is similar to that described in FIG. 2 in many ways and can be taken to be the same save for where it is explicitly stated to be different below.

Thus, there is turbine arrangement 310 which includes a rotor having a turbine blade 312 which attaches to the rotor disc 314 which is rotatable about the principal axis of the engine 331. The flow direction is left to right as shown in the Figure such that the aero foil portion 316 of the blade 312 receives the air from the upstream stator vane (not shown) which is located to the left of the blade 312. The flow of hot air rotatably drives the blade 312 and disc 314 and provides an axial rearward force. Aft of the rotor is a stator assembly 318. The stator assembly 318 includes the stator vane of the next turbine stage. The stator vane includes an aerofoil portion (not shown) and platform 320 as is known in the art.

A partitioning wall 322 extends radially inwards towards the centre of the engine between the static structure of the stator and the rotating structure. The partitioning wall 322 includes a stationary part 324 and a rotating part 326 which are divided by a seal arrangement 328 which allows the required relative rotation. The partitioning wall 322 and seal provide a separation between a first chamber 330 and a second chamber 332. The two chambers 330, 332 are held at respective first and second operational pressures when in use. The pressure of the first, upstream chamber 330 is higher than the pressure of the second, downstream chamber 332. The operating pressures are provided by compressor air which is bled from respective stages of the compressor and are selected relative to the corresponding main gas path air pressure.

The first chamber 330 is constructed from a first wall in the form of the rotor disc 314 and a second wall which is the partition wall 322. The second chamber 332 is constructed from the partition wall 322 and a rotor disc 314 of a second downstream rotor (not shown). The radially outboard end of the first chamber 330 is provided with a gap 334 which separates the rotor from the stator structure to allow for the relative rotation.

The gap 334 includes a seal member 336 in the form of a swan neck rim seal provided by an annular flange which extends axially from the stator assembly towards the rotor.

The seal member 336 is located with a suitable clearance which provides an acceptable operational separation between the rotor and the stator, thus allowing unhindered rotation.

The rotor forms part of a larger rotor structure (not shown) which includes a shaft and the rotor discs of the compressor (and optionally other turbine discs). The attachment between the rotor and the larger rotor structure is via a short shaft and flanged connection 338. The flanged connection is fixedly mounted to a corresponding structure with any suitable coupling structure such as a distributed circular array of bolts.

The seal arrangement 328 provides rotational separation of the rotating part and stationary part of the partition wall 322. The seal of the described embodiment is in the form of a stepped labyrinth seal which includes a rotating part having a seal plate 342 having a plurality of axially spaced circumferential seal fins 344 or teeth. The stationary part of the seal or seal carrier is mounted to the stationary portion 324 of the partition wall 322 and includes an abradable seal face which opposes the sealing fins 344. The abradable seal face is radially stepped to provide two seal faces at different radial heights.

The fins extend generally radially outwards towards the stationary part of the seal and provide a series of restrictions and expansions to provide a pressure drop across the seal. Thus, during normal use, the seal fins 344 are radially displaced from the seal faces by a minimal amount with any radial excursions resulting in the seal fins cutting into the seal faces.

The partition wall 322 includes a levered joint 346 which is triggered during particular failure modes which result in the rotor moving rearward by a predetermined amount or with a predetermined force. The triggering of the levered joint 346 results in the partition wall 322 separating into two segments so as to provide fluid communication between the first 330 and second 332 chambers. The fluid communication results in a rapid pressure relief of the first chamber 330 and allows the rearward movement of the rotor with an at least reduced or eliminated pneumatic buffer.

The predetermined amount required to trigger the levered joint 346 corresponds to a particular failure mode and a resultant expected axial shift. In the described embodiment, the predetermined amount is chosen to be shorter than the axial separating gap 334 between the rotor and stator. This could be determined by the separation of the seal and rotor or could be the binding sites of the rotor platform trailing edge 340 and the stator platform 320 leading edge. It will be appreciated that the contacting or binding sites may differ in different engine architectures. In the example shown in FIG. 3, the separation of the seal and rotor, and the blade and stator platforms are similar.

The levered joint 346 segments the partition wall 322 so as to provide two wall portions. Thus, the partition wall 322 includes a stationary element 324 and a rotating element 326 separated by a seal. Either of the stationary element 324 or the rotating element 326 of the partition wall 322 may be segmented by the levered joint 346. As can be seen it is the stationary component in the described example of FIG. 3.

The levered joint 346 includes a lever 348 having a trigger plate 350, a fixture portion 352 and a fulcrum portion 354. The lever 348 of the described example is provided by a circumferentially extending plate which includes a first end which abuts the partition wall 322 to provide the fulcrum portion 354; a second end which provides a trigger plate 350; and a fixture portion 352 therebetween. The fixture portion 352 includes a plurality of through-holes along the length thereof which receive bolts 358. In the example of FIG. 3, each bolt has a separate lever. Hence, there are as many levers as there are bolts. It will be appreciated that it may be possible for multiple bolts to be levered by a common or interconnected levers.

The other of the stationary element 324 and rotating element 326, in this case the rotating element, includes a hammer 360 which is axially aligned and separated from the trigger plate 350 in a first position which corresponds to the normal operating conditions of the engine when not in a failure mode. When the levered joint 346 is triggered, the hammer 360 forcibly strikes trigger plate 350 due to the rotor moving rewards. This creates a moment on the lever 348 between the trigger plate 350 and fulcrum portion 354 which pivots the lever 348 and forces the levered joint 346 apart. It will be appreciated that the movement of the hammer will require a predetermined amount of force to lever the joint apart.

The levered joint 346 of the example includes a stack of the abutment portions of each of the levered joint parts. Thus, there is a first wall abutment 362 which appends from the stator assembly, a second wall abutment 364 which provides the platform for the seal, and the lever. The first wall abutment 362 includes a recess in the downstream face thereof which is sized to receive the second wall abutment 364. The mating of the first and second abutments may be sealable so as to preserve the relative pressures in the first 330 and second 332 chambers. The outward facing surfaces of the first and second abutments are substantially planar and flush with one another to provide a contiguous mating surface of the inward facing, or mating surfaces, of the lever.

The second wall portion of the levered joint 346 is in the form of an annular band having radial and axial plates separated by 90 degrees so as to have an L-shaped longitudinal section. The junction between the axially and radially extending plates provides a shoulder which is received in a corresponding rebate in the lever. The axially extending plate carries the abradable sealing surfaces of the seal arrangement, whilst the radial plate provides abutment which forms part of the bolted union of the levered joint 346.

The lever 348 is radially orientated relative to the principal axis of the engine and includes a dog leg to provide a rebate into which the shoulder of the second wall portion is received, the combination providing an anti-rotation feature. The lever 348 is located in an abutting fashion with the first 362 and second 364 wall abutments so that the second wall abutment 364 is enveloped at its terminal end by the first wall abutment 362 and lever, and the fulcrum portion 354 of the lever 348 bears and pivots against the downstream surface of the first wall portion. Thus, in operation, when the levered joint is triggered and opened, the second wall portion, the seal portion of the partition wall is released. The anti-rotation shoulder prevents the rotation of the lever about the bolt and ensures that the lever acts axially against the bolt.

The lever 348 extends radially inwards beyond the second wall abutment 364 so as to provide a cantilever which is axially separated from and opposite the hammer 360.

The levered joint 346 is fixed together with a circumferential distribution of bolts 358. The bolts 358 are received through the first 362 and second 364 wall abutments and lever 348 in suitably sized and aligned holes. Hence, the first 362 and second 364 wall abutments and lever 348 are fixedly retained in a stack during normal operation of the engine, with second abutment being clamped between the first wall abutment 362 and lever fixture portion 352.

The bolts 358 are each carried in a bush 361 which passes through lever plate and second wall abutment 364. The bushes 361 are threaded or include a threaded insert which provides the threading engagement and retention of the bolts. However, it will be appreciated that the lever could be threaded in other examples.

The bushes include a cylindrical body which is received within the lever and seal carrier wall portion with an interference fit. The interference fit aids with moving the seal carrier rewards with the lever so as to separate the first and second wall abutments. The cylindrical body includes a central threaded bore for retaining the bolt. The proximal end of the cylindrical body includes a stop in the form of a flanged end which abuts the outside surface of the fixture portion of the lever to prevent extraction through the lever.

The hammer 360 of the described example is in the form of the seal body. The seal body provides a platform on to which is mounted the sealing fins which sealably oppose the abradable seal surfaces of the seal carrier. The seal forms part of the partition wall 322 and allows the relative rotation of the rotating and stationary parts thereof. The seal body is carried on a swan neck arrangement and extends predominantly in an axial direction with a slight radial inclination so that the sealing side of the seal body faces downstream. The sealing fins extend from the seal body and are inclined in the upstream direction.

The swan neck forms a chicane in longitudinal cross-section. The chicane extends from the terminal end of a radial portion of rotating wall element and includes two bends. The first bend inclines the support wall for the seal body downstream. The second bend provides the hammer 360 and returns the trajectory of the seal body upstream in a predominantly axial direction but with a minor radial component. The seal fins extend from the radially outward facing surface of the seal body.

Figure 4A:
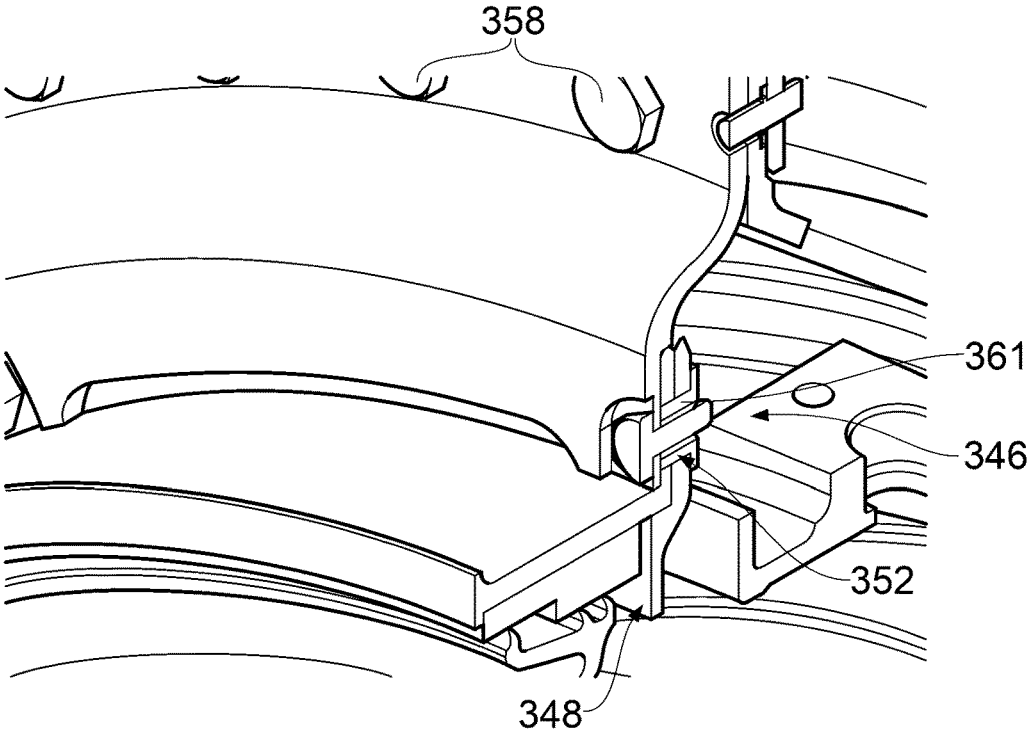
FIGS. 4*a* and 4*b* show respective isometric downstream and upstream sectional views of the levered joint shown FIG. 3.
Figure 4B:
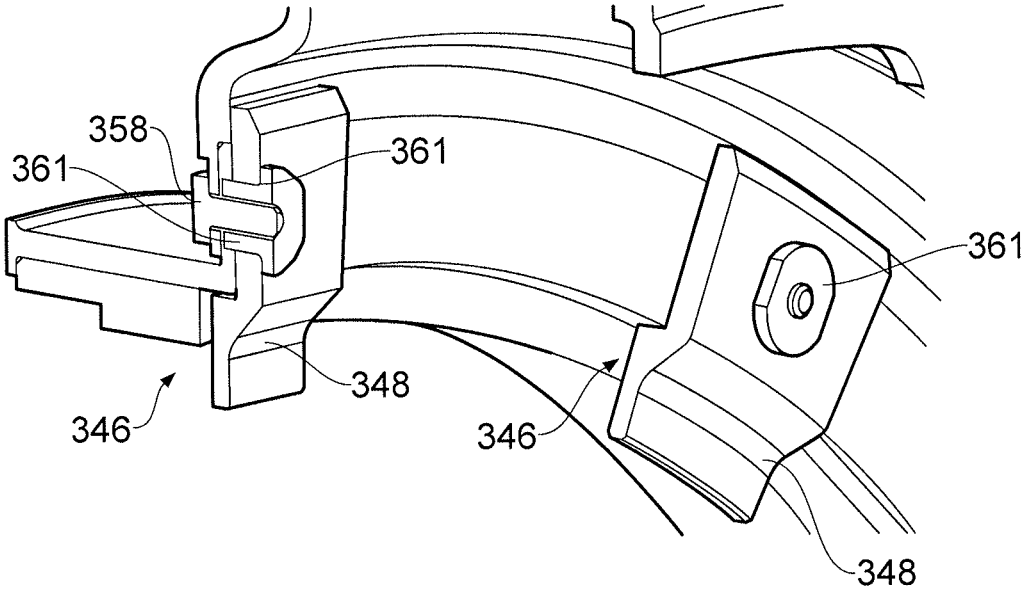

FIGS. 4*a* and 4*b* show respective upstream and downstream isometric views of the levered joint 346 depicted in FIG. 3. Thus, there is shown the partition wall 322, the levered joint 346 having the first and second abutments and lever, and the seal arrangement. The upstream side of the first wall portion, in particular the first wall abutment 362 includes a plurality of pressure relief vents. The pressure relief vents are in the form of a castellations or scallops in the edge end of the first wall portion but it will be appreciated that such pressure relief vents could be provided by any suitable apertures, such as bored holes.

Under normal operating conditions, the pressure relief vents terminate against the adjacent abutting wall of the second wall abutment 364 and the sealing interface therebetween. Hence, there is no fluid pathway from the first chamber 330 to the second chamber 332 via the pressure relief vents. When the levered joint 346 is triggered the second wall abutment 364 moves axially rearwards which opens the pressure relief vents and provides the fluid communication required to provide a rapid pressure equalisation between the first two chambers and a depressurisation of the first chamber.

Figure 5:
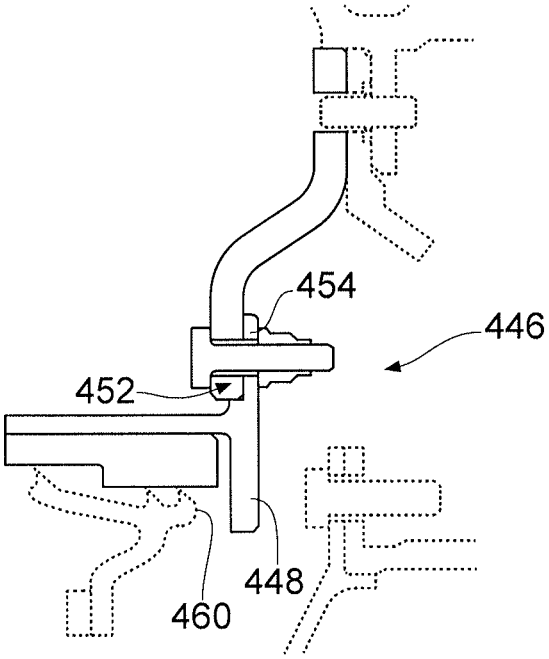
FIG. 5 shows a further example of a levered joint.

FIG. 5 shows a further example of a levered joint 446. Here, the lever 448 is part of the seal carrier. Hence, the second wall abutment 364 provides the fulcrum 454 and fixture portion 452 of the lever, and the trigger plate is provided in the form of a flange which extends from the seal carrier radially inwards so as to be presented in axial alignment with the hammer 460.

Figure 6:
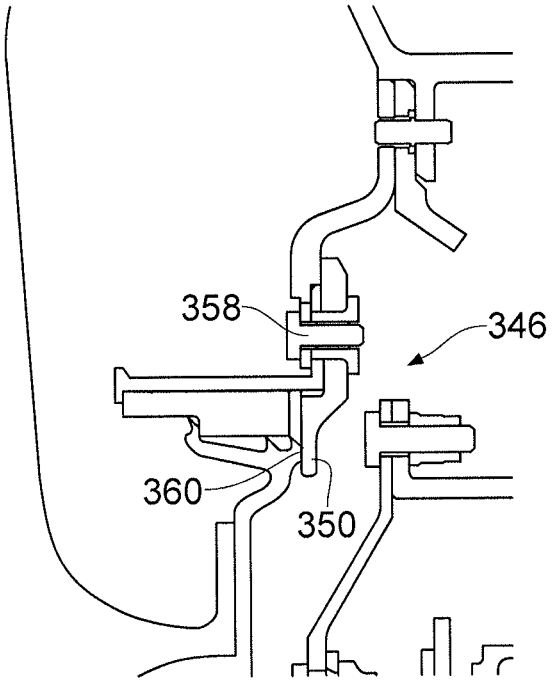
FIGS. 6 to 8 show incremental triggering positions of the arrangement shown in FIG. 3.
Figure 7:
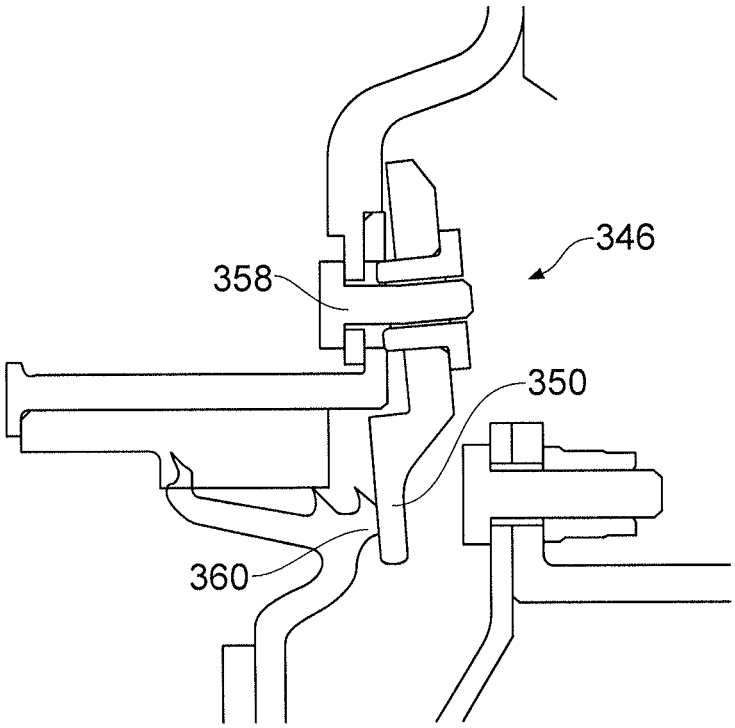
Figure 8:
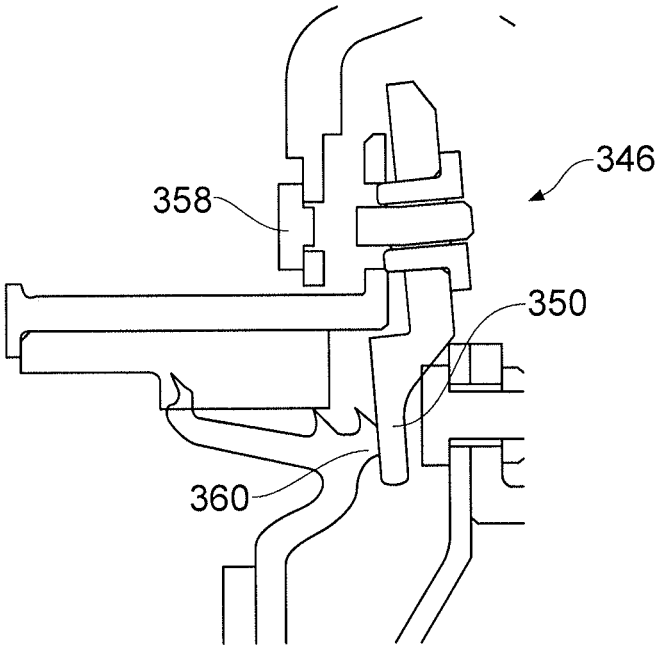

FIGS. 6 to 8 show the levered joint 346 during a failure mode event. FIG. 6 shows the initial movement and contact of the hammer 360 and trigger plate 350, prior to any deformation of the bolts 358. FIG. 7 shows the levering of the bolt and plastic deformation as the hammer 360 continues to move rearward. FIG. 8 shows the sheared bolt 358*a* and the disconnection of the static seal carrier and opening up of the partitioning wall. It can be noted that the seal fins engage with the abradable honeycomb portions of the seal static when moving. This results in the seal body pushing the seal wall forward to aid separation. However, it will be appreciated that the honeycomb portions are suitably deformable such that the hammer action is not detrimentally obstructed.

It will be appreciated that although the above described arrangements put the fulcrum at the one end of the lever and the trigger plate at the other, there may be some examples in which the fulcrum is located between the trigger plate and the fixture portion. There may also be examples in which the hammer is not provided by one or more parts of the seal. For example, the hammer may be provided by the rotor disc which is spaced from the seal body by the required predetermined amount. In this case, the seal body would be the trigger plate and the cantilever would no longer be required.

The invention claimed is:

1. A gas turbine engine, comprising:

a first chamber and a second chamber axially separated by a partition wall;

wherein the partition wall includes a stationary element and a rotating element forming a seal and either of the stationary element and the rotating element of the partition wall is segmented by a levered joint, and the other of the stationary element and rotating element includes a hammer, wherein the levered joint includes a lever having a trigger plate, a fixture portion and a fulcrum portion; and, wherein the hammer is axially aligned and separated from the trigger plate in a first position of the hammer, the hammer forcibly contacting the trigger plate in a second position of the hammer so as to create a moment on the lever about the fulcrum portion via the trigger plate, the moment forcing the levered joint apart.

2. The gas turbine engine as claimed in claim 1, wherein the seal is a labyrinth seal having a plurality of fins extending from the hammer.

3. The gas turbine engine as claimed in claim 1, wherein the lever has a first end at which the trigger plate is located and a second end at which the fulcrum portion is located and the fixture portion is located therebetween.

4. The gas turbine engine as claimed in claim 1, wherein the levered joint includes a first wall abutment and a second wall abutment which are adjacent and abutting one another in the first position of the hammer and the second wall abutment is formed from part of the lever.

5. The gas turbine engine as claimed in claim 1, wherein the levered joint includes a first wall abutment and a second wall abutment, and wherein in the first position of the hammer the first wall and second wall abutments and lever are axially stacked with the second wall abutment sandwiched between the first wall abutment and the lever, and the fulcrum portion bares against the first wall abutment.

6. The gas turbine engine as claimed in claim 4, wherein the first wall abutment sealably engages with the second wall abutment in the first position of the hammer and permits fluid communication between the first and second chambers in the second position of the hammer.

7. The gas turbine engine as claimed in 6 wherein a pressure relief vent provides the fluid communication.

8. The gas turbine engine as claimed in claim 1, further comprising a plurality of levers including the lever, wherein the plurality of levers are circumferentially distributed around the partition wall.

9. The gas turbine engine as claimed in claim 8 wherein the levered joint includes a plurality of circumferentially distributed bolts and wherein each bolt is coupled to a respective lever of the plurality of levers in the first position of the hammer.

10. The gas turbine engine as claimed in claim 9, wherein the bolts are received within a respective sliding bush.

11. The gas turbine engine as claimed in claim 10, wherein each sliding bush passes through the fixture portion.

12. The gas turbine engine as claimed in claim 1, wherein the trigger plate extends from a stationary portion of the seal in the first position of the hammer.

13. The gas turbine engine as claimed in claim 1, wherein the first chamber is bounded by a turbine rotor and the rotating part of the partition wall is attached to the turbine rotor and a stationary part of the partition wall is attached to a downstream stator assembly.

14. The gas turbine engine as claimed in claim 13, wherein the turbine rotor includes a turbine blade and the stator assembly includes a stator vane, the turbine blade and stator vane having platforms which are axially separated by a gap in the first position of the hammer, wherein the axial separation of the gap is greater than an axial separation of the hammer and trigger plate in the first position of the hammer.

* * * * *